US006186365B1

(12) United States Patent
DeJonge

(10) Patent No.: US 6,186,365 B1
(45) Date of Patent: Feb. 13, 2001

(54) PUMP SPRAYER WITH SLIDE LOCK

(75) Inventor: Stuart DeJonge, Easton, PA (US)

(73) Assignee: Calmar Inc., City of Industry, CA (US)

( * ) Notice: Under 35 U.S.C. 154(b), the term of this patent shall be extended for 0 days.

(21) Appl. No.: 09/533,165

(22) Filed: Mar. 22, 2000

(51) Int. Cl.[7] ..... B67B 5/00
(52) U.S. Cl. ..... 222/153.13; 222/321.9
(58) Field of Search ..... 222/153.13, 321.9

(56) References Cited

U.S. PATENT DOCUMENTS

| | | | | |
|---|---|---|---|---|
| 3,169,672 | | 2/1965 | Soffer et al. . | |
| 3,797,705 | | 3/1974 | Cooprider . | |
| 3,907,174 | | 9/1975 | Steiman . | |
| 4,566,611 | | 1/1986 | Sukopp . | |
| 4,752,020 | | 6/1988 | Grueter et al. . | |
| 5,228,849 | | 7/1993 | Frigiere . | |
| 5,284,264 | | 2/1994 | Gross . | |
| 5,366,118 | * | 11/1994 | Ciammitti et al. | 222/153.13 |
| 5,492,251 | | 2/1996 | Albini et al. . | |
| 5,518,147 | * | 5/1996 | Peterson et al. | 222/153.13 |

* cited by examiner

*Primary Examiner*—Philippe Derakshani
(74) *Attorney, Agent, or Firm*—Dykema Gossett PLLC

(57) ABSTRACT

A pump sprayer having a lock slidably mounted on the plunger head for locking the pump sprayer against reciprocation within a sleeve on a closure provided for mounting the sprayer to a container. The lock has a body with a rear portion, a cap portion, a pair of arms with flanges and a stop projection. The arms define springs in one embodiment for engaging a portion of the pump sprayer and providing a restoring force that enables the locking mechanism to be self-resetting to a locked position. The body is capable of being moved by the operator of the pump sprayer within the peripheral outline of the plunger head. When in a forward position, the lower edge of the rear portion of the lock is disengaged from an upper edge of the sleeve placing the pump sprayer in an unlocked position. When the projection is released and the plunger head is reciprocatingly restored to an upright position, the lower edge of the rear portion automatically engages the upper edge of the sleeve of the pump sprayer preventing plunger head reciprocation and the biasing means automatically forces the lock into a rearward, locked position on the plunger head thus rendering the pump sprayer self-resetting and child-resistant. In another embodiment the lock is a shipper lock which does not reset from its locked position.

17 Claims, 2 Drawing Sheets

PUMP SPRAYER WITH SLIDE LOCK

The '264 patent issued to Gross is for a "Toggle-Action Dispensing Closure With Slide Lock". This particular device comprises a cap having a locking member slidably mounted within an actuator that can prevent pivoting of the actuator. When in a locked position, the locking member is slid partially out of the actuator until it comes into contact with a lip of the cap of the dispenser. When the actuator is pressed down, the locking member hits against the lip of the cap and prevents the actuator from pivoting. To unlock the actuator, the user slides the locking member into the actuator so the end of the locking member is free from the lip of the cap allowing the actuator to rotate.

The '251 patent for a "Pressurized Liquid Dispenser With Members For Locking It In Its Lowered Position" issued to Albini et al. shows a pressurized dispenser that has a dispenser head with a skirt portion having a tooth that can be engaged with a rib locking the dispenser head in a fully depressed position and preventing further use of the dispenser. The user can manually release the tooth from its engaged position with the rib by pressing on a tongue portion of the dispenser head which releases the tooth and allows the dispenser head to move to a raised position wherein it can then be depressed in a pumping action.

A drawback common to all the solutions developed in the prior art is once the locking mechanism has been unlocked, the dispenser may be readily used. In other words, the dispensers are not child-resistant unless the locks are manually placed in their locked positions once again. Also, the locks or locking elements will not automatically reset themselves into a locked position after every use. In view of the state of the prior art, there exists a need for an improvement of the existing lockable dispensers given the limitations of the existing art.

It is possible to make a pump sprayer child-resistant by requiring that a two-step action be performed in order to operate the sprayer, such as pushing in while simultaneously depressing an actuator or the like. This dual-action renders the sprayer child-resistant given that children under a certain age generally cannot readily perform both functions simultaneously that are necessary to operate the pump sprayer.

The provision of spring-biased arms on the pump sprayer allows for the lever to be automatically returned to a locked position after every use.

SUMMARY OF THE INVENTION

It is an object of the present invention to provide a child-resistant pump action sprayer wherein a lock is attached to the plunger head so as to render the same easily operable by an adult yet difficult for a child to operate while permitting the sprayer to automatically reset itself into the locked position when not in use.

According to the first embodiment of the invention, the pump sprayer has a lock slidably mounted on the plunger head for immobilizing depression of the plunger. The lock has a body with a rear portion, a cap portion, a pair of biasing means with flanges and a stop projection. The biasing means engage a portion of the pump sprayer and provide a restoring force that enables the locking mechanism to reset itself into a locked position. The body of the lock is capable of being moved within the plunger head by the user of the pump sprayer. When in an unlocked position, a lower edge of the rear portion is disengaged from an upper edge of the sleeve. When the plunger head is in an upright position, the rear portion of the lock body is biased away from the plunger head to a position where the lower edge of the rear portion engages the upper edge of the sleeve of the pump sprayer and prevents plunger depression. The biasing means of the lock automatically forces the lock into a locked position on the plunger head thus rendering the pump sprayer self-resetting and child-resistant.

The second embodiment of the invention comprises a lock that is also slidably mounted on the plunger head for immobilizing depression of the plunger. The lock has a body with a rear portion, a cap portion, a stop projection, and a pair of resilient arms with flanges and ribs. Each rib engages one of a plurality of grooves on an inner sleeve of the plunger head and helps retain the locking mechanism in a specific position, either locked or unlocked. The body of the lock is capable of being moved within the plunger head by the user of the pump sprayer. When the lock is positioned with the stop projection directly adjacent the inner sleeve, a lower edge of the rear portion is disengaged from an upper edge of the sleeve placing the sprayer in an unlocked position. When the lock is positioned with the stop projection located a distance from the inner sleeve, the rear portion of the lock body is positioned away from the plunger head and the lower edge of the rear portion engages the upper edge of the sleeve of the pump sprayer, thus preventing the plunger head from moving. The ribs on the resilient arms and corresponding grooves on the inner sleeve allow the lock to be manually placed in a locked position or in an unlocked position. When in the locked position, the pump sprayer can be easily shipped without the threat of the plunger head being depressed.

Other objects, advantages and novel features of the invention will become more apparent from the following detailed description of the invention when taken in conjunction with the accompanying drawings.

DETAILED DESCRIPTION OF THE INVENTION

Figure 1:
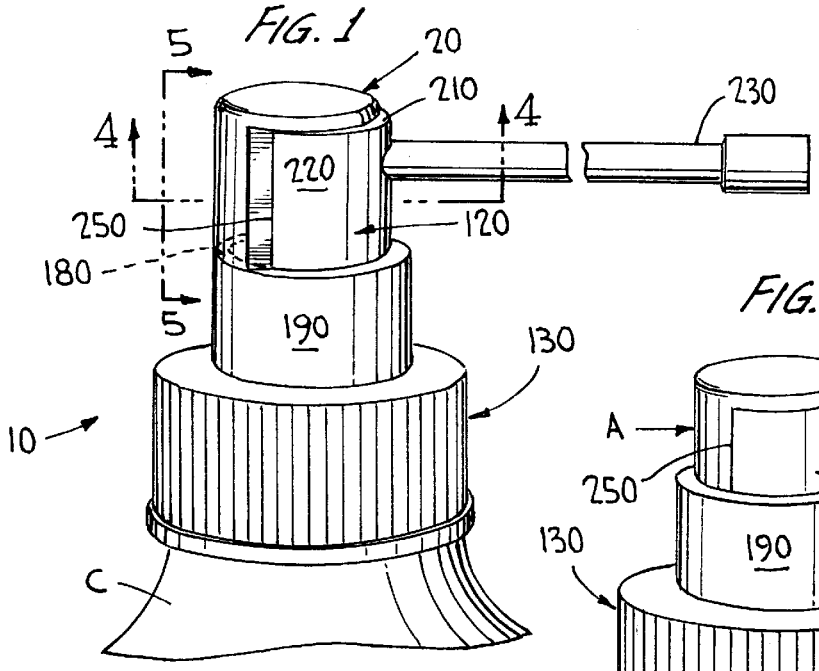
FIG. 1 is a perspective view of a first embodiment of a pump sprayer according to the invention with the plunger head shown in a locked position against reciprocation.
Figure 2:
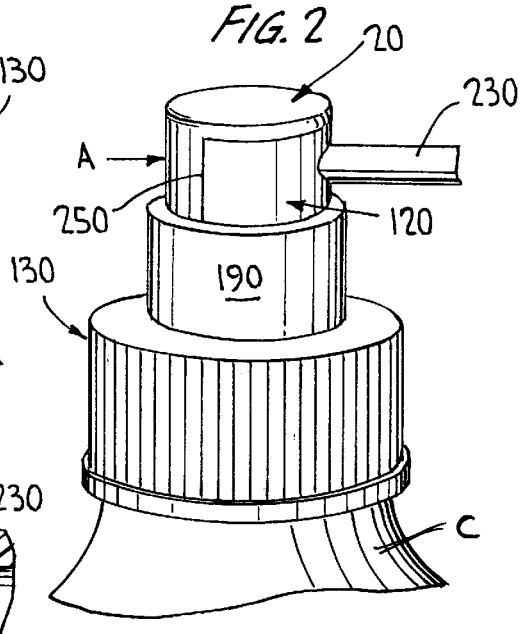
FIG. 2 is a view similar to FIG. 1, with the plunger head shown in an unlocked and slightly depressed position.

Referring to FIGS. 1 and 2, the pump sprayer 10 generally includes a closure 130 for mounting the sprayer to a container C, a plunger head 120 and a locking mechanism 20. The closure 130 has an upstanding sleeve 190 surrounding the plunger head 120 as in a known manner.

Figure 5:
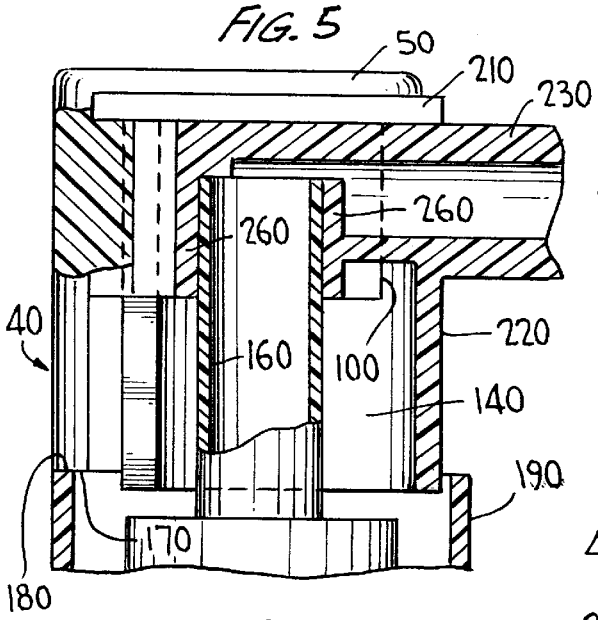
FIG. 5 is a partial, cross-sectional view of the first embodiment of the pump sprayer taken along line 5—5 of FIG. 1.

The plunger head 120 reciprocatingly engages the sleeve 190 permitting it to be pushed by a user in a manner known in the art. The plunger head 120 has a tubular sidewall 220 (FIGS. 1 and 4), a top wall 210 (FIGS. 1 and 5), an inner sleeve 260 (FIG. 4) and a spout 230. The sidewall 220 has an inner surface 140 (FIG. 4) and a cut-out portion 250 within which is located the locking mechanism 20 of the present invention. The plunger head 120 can also be made of unitary construction.

The lock 20 slidably engages the plunger head 120 and is capable of maintaining the plunger head 120 in a locked position (FIG. 1) preventing the plunger head 120 from reciprocating. When the lock 20 is moved to an unlocked position (FIG. 2), the plunger head 120 is free to reciprocate within the pump sprayer 10 in a manner known in the art.

Figure 3:
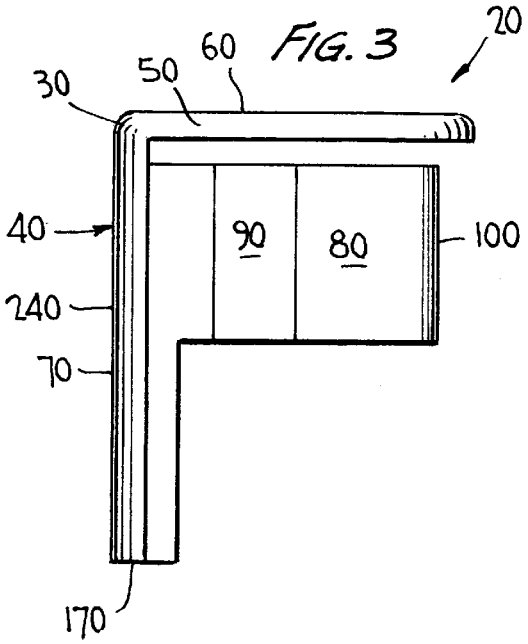
FIG. 3 is an enlarged side elevational view of the lock element according to the first embodiment of the invention.

As shown in FIG. 3, the lock is comprised of a body 30 with a rear portion 40 having a substantially U-shaped cross-section and a cap portion 50. The cap portion 50 has a top or first finger engaging surface 60, and the rear portion 40 has an outer or second finger engaging surface 70. A user can push the second finger engaging surface 70 to slide the lock 20 into an unlocked position and press down on the first finger engaging surface 60 to depress the plunger head 120 and thus operate the pump sprayer 10 in a manner known in the art.

A pair of biasing means comprised of spring-biased resilient arms 80 extend from the rear portion 40. Each resilient arm 80 has an end 100 adapted to engage a confronting portion of the inner surface 140 of the sidewall 220 of the plunger head 120. When the lock 20 is placed in the locked position (FIGS. 1, 4 and 5), the resilient arms 80 are of such a length that the ends 100 touch the inner surface 140 of the sidewall 220 and a slight spring force is applied to the inner surface 140 so as to snugly retain the lock 20 in place within the plunger head 140. However, when the lock 20 is placed in the unlocked position (FIG. 2), each end 100 is more forcefully pressed against the inner surface 140 causing each resilient arm 80 to slightly deform against the inner surface 140 and restoring pressures to be formed within each resilient arm 80 (shown in phantom lines in FIG. 4).

On the inside of the lock body 30, is a stop projection 110 that extends from the rear portion 40 in the same direction and parallel with the resilient arms 80. The stop projection 110 is used to prevent the lock 20 from further movement when the stop projection 110 engages the inner sleeve 260 of the plunger head 120. This stop projection 110 also helps to maintain the lock 20 in a proper orientation or relationship with the other elements of the pump sprayer 10 by preventing the movement of the lock 20 too far in one direction.

Figure 4:
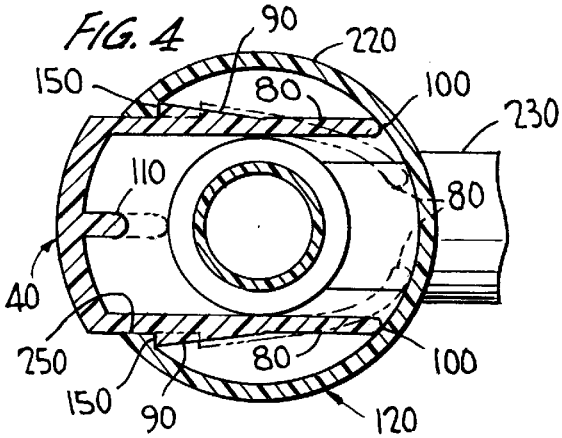
FIG. 4 is a cross-sectional view of the first embodiment of the pump sprayer taken along line 4—4 of FIG. 1.

A flange 90 (FIG. 4) projects from each resilient arm 80 and forms a shoulder 150 that is used to prevent the lock 20 from being removed from the plunger head 120 by abutting the shoulder 150 against the sidewall 220 of the plunger head 120 when the lock is in a locked position as shown in FIG. 4.

When installed on the pump sprayer 10, the resilient arms 80 are located on opposite sides of the inner sleeve 260 of the plunger head 120 (FIG. 4) and their primary purpose is to force the lock 20 in a direction away from the inner sleeve 260 until the shoulder 150 of each flange 90 comes to bear against the plunger head sidewall 220, thus preventing any further movement away from the plunger head 120 by the lock 20.

The stop projection 110 and cap portion 50 are integrally formed with the rear portion 40 of the lock body 30, and the flanges 90 are integrally formed with the resilient arms 80, making the lock 20 a single, unitary piece.

In the locked position, as shown in FIG. 1, the restoring forces of the resilient arms 80 cause the lock 20 to shift laterally outwardly of the plunger head 120 so the lock 20 is in a slightly offset position from the plunger head 120. Within the plunger head 120, the ends 100 of each resilient arm 80 (FIG. 4) touch the inner surface 140 of the plunger head sidewall 220. The stop projection 110 is located a distance from the inner sleeve 260 and a lower edge 170 of the rear portion 40 of the lock 20 abuts the upper edge 180 of the sleeve 190 preventing the lock 20 and the plunger head 120 from being depressed and activating the pump sprayer 10.

To unlock the pump sprayer 10, the lock 20 is moved toward the plunger head 120 (in the direction of arrow A in FIG. 2) to a position where the lower edge 170 of the lock body 20 is free and no longer abuts the upper edge 180 of the sleeve 190. The user can identify this position when the stop projection 110 meets or abuts against the inner sleeve 260.

To operate the pump sprayer 10 of the first embodiment (FIGS. 1–5), the user grasps the container C (partially shown in FIG. 1) of the pump sprayer 10 with a hand while resting the middle of the forefinger against the second finger engaging surface 70 of the lock 20 in such a manner so as to allow the fingertip portion of the forefinger to overhang and press against the first finger engaging surface 60 of the cap portion 50 of the lock 20. While the pump sprayer 10 is grasped in this position, a slight pressure is applied against the second finger engaging surface 70 with the middle of the forefinger causing the lock 20 to slide toward the plunger head 120, shown by the arrow A in FIG. 2. While pressing the lock 20 toward the plunger head 120, a pressure is applied to the first finger engaging surface 60 with the fingertip depressing the cap portion 50. This motion causes the cap portion 50 to press against the top 210 of the plunger head 120 causing the plunger head 120 to actuate the pump sprayer 10. The dual action of pushing the lock 20 toward the plunger head 120 while pressing it down renders the pump sprayer 10 child-resistant.

When the lock 20 is moved toward the plunger head 120, the resilient arms 80 are forced against the inner surface 140 of the plunger head sidewall 220 where they provide a constant restoring force against the lock 20 (shown in phantom lines in FIG. 4). Slight restoring forces may be present even when the lock 20 is in the locked position (FIG. 1) but are increased when the rear portion 40 is pushed toward the plunger head 120 freeing the lower edge 170 of the rear portion 40 from abutting against the upper edge 180 of the sleeve 190. The restoring forces provide constant rearward forces on the lock 20 and enable the pump sprayer 10 to be self-resetting.

As the lock 20 is released, the return force of the plunger spring (not shown) forces the lock 20 to a raised position within the plunger head 120 and the restoring forces of the resilient arms 80 force the lock 20 away from the plunger head 120 to a position on the pump sprayer 10 wherein the lower edge 170 of the rear portion 40 abuts against the upper edge 180 of the sleeve 190. By placing the lock 20 in this position, any further movement of the plunger head 120 within the sleeve 190 is prevented and the pump sprayer 10 is placed in a locked position (FIG. 1).

Figure 6:
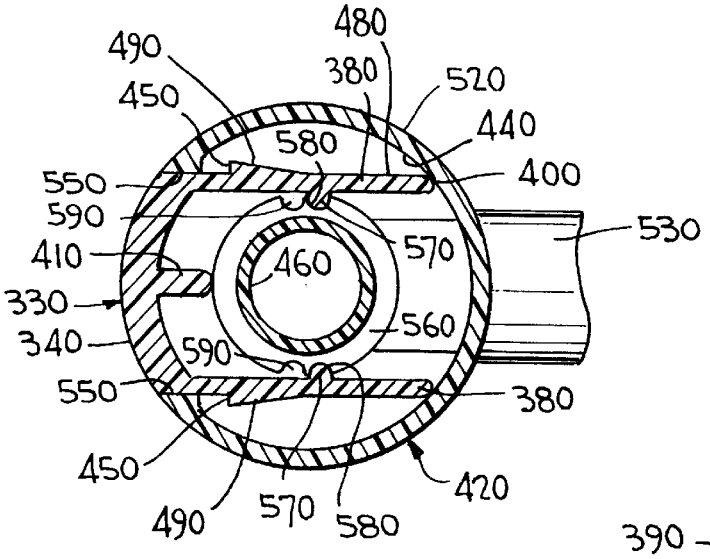
FIG. 6 is a cross-sectional view of the second embodiment of the pump sprayer showing the lock element in an unlocked position.
Figure 7:
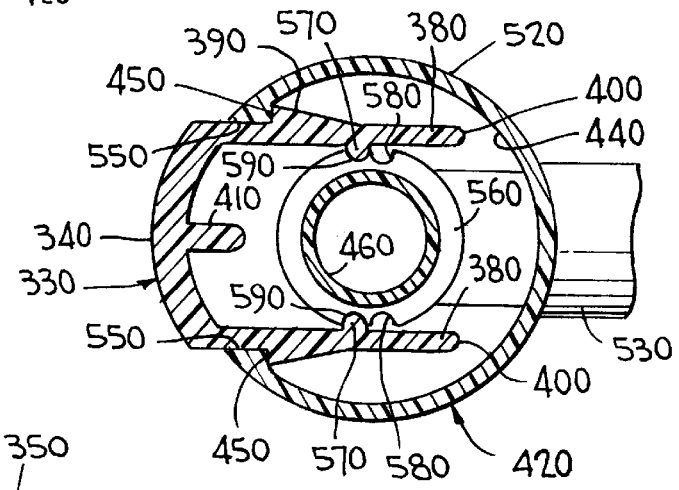
FIG. 7 is a cross-sectional view of the second embodiment of the pump sprayer showing the lock element in a locked position.
Figure 8:
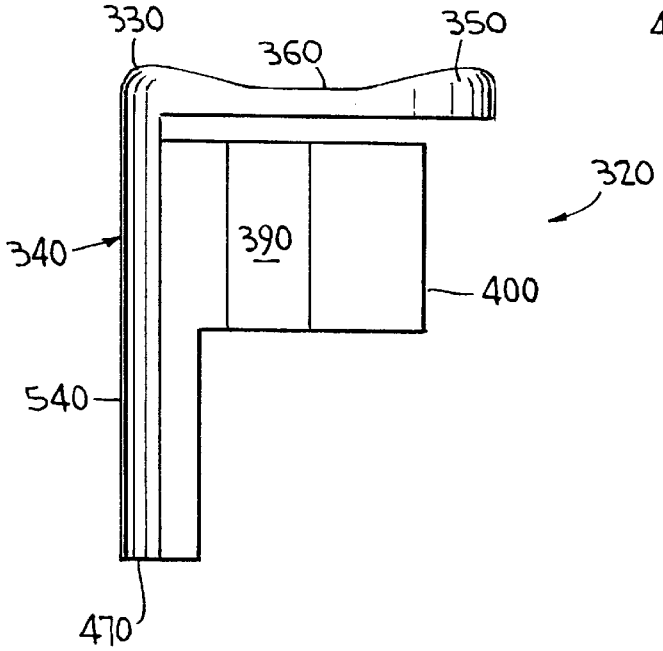
FIG. 8 is an enlarged side elevational view of the lock element of the present invention according to the second embodiment.

A second embodiment of the locking means is illustrated in FIGS. 6–8. The lock 320 is slidably mounted on the plunger head similarly as described with reference to the first embodiment as illustrated in FIGS. 1–5.

Referencing FIGS. 6–8, the lock 320 has a body 330 with a rear portion 340, a cap portion 350, arms 380 having flanges 390, retaining means 570 and a stop projection 410. The arms 380 may or may not be resilient in nature. The retaining means have ribs 570 that engage corresponding grooves 580,590 located on the outer perimeter of the inner sleeve 560 of the plunger head 420. The fitting relationship of the ribs 570 within the grooves 580,590 helps to locate the locking mechanism 320 in either a locked (FIG. 7) or an unlocked (FIG. 6) position. The body 330 of the lock 320 is capable of being manually moved from one position to another, within the plunger head 420, by the user of the pump sprayer (not shown). When the lock 320 is positioned with the stop projection 410 adjacent the inner sleeve 560 (FIG. 6), a lower edge 470 (FIG. 8) of the rear portion 340 is disengaged from an upper edge of the sleeve placing the pump sprayer in an unlocked position. When the lock 320 is positioned with the stop projection 410 located a distance from the inner sleeve 560 (FIG. 7), the rear portion 340 of the lock body 330 is positioned away from the plunger head 420 and the lower edge 470 of the rear portion 340 abuts against the upper edge 480 of the sleeve 490 of the pump sprayer, thus preventing the pump sprayer from being activated. The ribs 570 of the arms 380 and the corresponding grooves 580,590 of the inner sleeve 560 allow the lock 320 to be manually placed in a locked position or an unlocked position. When the rib 570 of each arm 380 engages the first groove 580, the lock 320 is placed in the locked position. This locked position allows for the pump sprayer to be easily shipped without threat of the plunger head 420 being depressed or the pump sprayer being activated, the sprayer in this situation is known as a "shipper". Pump sprayers that have this second embodiment of the lock are capable of being locked during shipping or transportation and then unlocked when they reach the ultimate consumer. When the ribs 570 are placed in the second groove 590, the lock 320 is in an unlocked position wherein the plunger head 420 can be depressed and the pump sprayer actuated.

The second embodiment of the lock 320, as shown in FIG. 8, is similar to the first embodiment of the lock 20, as shown in FIG. 3, with the addition of the first finger engaging surface 360 of the cap portion 350 having a slight groove therein to allow the forefinger of the user to more easily move the lock 320.

Some of the similarities between the two embodiments are that in both versions, the lock 20,320 is slidably mounted on the plunger head 120,420. Both locks 20,320 also have a pair of arms 80,380 with flanges 90,390 for keeping the lock 20,320 within the plunger head 120,420.

One difference between the two embodiments is that the lock 20 in the first embodiment (FIGS. 1–5) is capable of resetting itself into a locked position whereas the lock 320 in the second embodiment (FIGS. 6–8) must be manually set into a specific position. Another difference is that in the second embodiment, the ribs 570 on the arms 380 can be placed in either the first grooves 580 or the second grooves 590 of the inner sleeve 560. Yet another difference is that the first finger engaging surface 360 of the second embodiment is slightly notched so as to enable the forefinger of the user to better engage the cap portion when moving the lock 320 between an unlocked position (FIG. 6) and a locked position (FIG. 7).

Although two particular embodiments of the invention have been described in detail herein with reference to the accompanying drawings, it is to be understood that the invention is not limited to these two embodiments, and that various changes and modifications are possible.

A foreseeable alternative embodiment may include the biasing means as tension means instead of a compression means.

Such changes and modifications may be effected by one skilled in the art without departing from the scope or spirit of the invention as defined in the appended claims.

What is claimed is:

1. A self-resetting child-resistant pump sprayer comprising:

a plunger head reciprocable within a sleeve on a closure provided for mounting the sprayer to a container;

a locking means having biasing means and being coupled to said plunger head for preventing pump actuation in a first position;

said locking means having a portion thereof in abutting engagement with a confronting portion of said sleeve in said first position preventing actuation of said pump sprayer;

said locking means capable of being manually moved against the bias of said biasing means from said first position to a second position in which said locking means is out of engagement with said confronting portion of said sleeve, permitting actuation of said pump sprayer;

said biasing means automatically returning said locking means to said first position.

2. The self-resetting child-resistant pump sprayer according to claim 1, wherein:

said biasing means has retention flanges extending toward one another for engaging a confronting portion of said plunger head and retaining said locking means within said plunger head.

3. The self-resetting child-resistant pump sprayer according to claim 2, wherein:

said biasing means includes a pair of spaced resilient arms having ends adapted to engage said plunger head.

4. The self-resetting child-resistant pump sprayer according to claim 3, wherein:

said locking means includes a body having a cap portion and a rear portion;

said cap portion extending from said body and covering a top portion of said plunger head; and said resilient arms being interconnected with said body and extending from said body in substantially parallel relationship to one another.

5. The self-resetting child-resistant pump sprayer according to claim 4, wherein:

said locking means has a stop projection extending from said body and located between said pair of resilient arms for engaging a portion of said pump sprayer and for limiting movement of said locking means.

6. The self-resetting child-resistant pump sprayer according to claim 5, wherein:

said locking means is of unitary construction.

7. A lockable pump sprayer comprising:

a plunger head reciprocable within a sleeve of a closure provided for mounting the pump sprayer to a container;

a locking means supported by said plunger head, said locking means preventing pump actuation in a locked position;

said locking means having a portion thereof in abutting engagement with a confronting portion of said sleeve in said locked position;

said locking means having arms;

said locking means being movably mounted within said plunger head; and said locking means capable of being manually moved from said locked position to an unlocked position in which said locking means is out of engagement with said confronting portion of said sleeve, permitting actuation of said pump sprayer.

8. The lockable pump sprayer according to claim 7, wherein:

retaining means cooperating between said locking means and said pump sprayer are provided for retaining said locking means in said locked or said unlocked position.

9. The lockable pump sprayer according to claim 8, wherein:

said retaining means comprises a rib on at least one of said arms and a plurality of corresponding grooves on said plunger head, wherein said rib matingly engages at least one of said corresponding grooves to retain said locking means in said locked or said unlocked position.

10. The lockable pump sprayer according to claim 9, wherein:

said locking means has a body with a stop projection extending therefrom, said stop projection located between said arms and for engaging a portion of said pump sprayer to limit movement of said locking means toward said unlocked position; and said arms have flanges extending away from one another for engaging a confronting portion of said plunger head and limiting movement of said locking means toward a locked position.

11. The lockable pump sprayer according to claim 10, wherein:

said body has a cap portion and a rear portion; and said cap portion extending away from said body.

12. The lockable pump sprayer according to claim 11, wherein:

said locking means is of unitary construction.

13. A lock for use with a pump sprayer comprising:

a body having a rear portion, a cap portion and arms with flanges, said flanges for engaging a portion of the pump sprayer;

said cap portion extending from said body for covering a top portion of a plunger head of the pump sprayer;

said rear portion abutting a confronting portion of the pump sprayer; and said arms having ends adapted to engage a portion of the pump sprayer.

14. The lock according to claim 13, wherein:

said arms extend from said body in a substantially parallel relationship to one another;

said arms have flanges extending laterally therefrom and are adapted to engage a shoulder of the pump sprayer; and said arms adapted to automatically return said lock to a locked position on the pump sprayer.

15. The lock according to claim 14, wherein:

said lock has a stop projection extending from said body and located between said arms; and said stop projection engaging a portion of the pump sprayer for limiting movement of said lock.

16. The lock according to claim 13, wherein:

said arms have flanges extending laterally therefrom and being adapted to engage a shoulder of the pump sprayer;

said lock has retaining means for retaining said lock in a locked or unlocked position.

17. The lock according to claim 16, wherein:

said body has a stop projection extending therefrom and located between said arms, said stop projection engaging a portion of the pump sprayer and limiting movement of said lock.

* * * * *